United States Patent [19]

Hayashi

[11] Patent Number: 4,627,397

[45] Date of Patent: Dec. 9, 1986

[54] COOLING SYSTEM FOR AUTOMOTIVE ENGINE OR THE LIKE

[75] Inventor: Yoshimasa Hayashi, Kamakura, Japan

[73] Assignee: Nissan Motor Co., Ltd., Yokohama, Japan

[21] Appl. No.: 780,936

[22] Filed: Sep. 27, 1985

[30] Foreign Application Priority Data

Sep. 29, 1984 [JP] Japan ..... 59-202945

[51] Int. Cl.[4] ..... F01P 3/22; F01P 3/12

[52] U.S. Cl. ..... 123/41.27; 123/41.33

[58] Field of Search ..... 123/41.2–41.27, 123/41.33, 196 AB

[56] References Cited

U.S. PATENT DOCUMENTS 2,844,129 7/1958 Beck, Jr. et al. ..... 123/41.21

4,367,699 1/1983 Evans ..... 123/41.33

4,520,767 6/1985 Roettgen et al. ..... 123/41.33

4,548,183 10/1985 Hayashi ..... 123/41.21

4,565,162 1/1986 Seki et al. ..... 123/41.21

4,570,579 2/1986 Hirano ..... 123/41.27

*Primary Examiner*—William A. Cuchlinski, Jr.

*Attorney, Agent, or Firm*—Schwartz, Jeffery, Schwaab, Mack, Blumenthal & Evans

[57] ABSTRACT

In order to quickly bring the temperature of both the engine and the engine lubricant up to desired operational temperatures and subsequently prevent overheating of the same, an oil cooler is integrated with an evaporative type engine cooling system in a manner that the temperature of the engine oil is controlled essentially in parallel with engine coolant. The engine load and/or engine speed are sampled and the cooling system operated in a manner to vary the boiling point of the coolant in accordance therewith.

15 Claims, 19 Drawing Figures

COOLING SYSTEM FOR AUTOMOTIVE ENGINE OR THE LIKE

BACKGROUND OF THE INVENTION

1. Field of the Invention

The present invention relates generally to a cooling system for an internal combustion engine wherein a liquid coolant is permitted to boil and the vapor used as a vehicle for removing heat from the engine, and more specifically to such a system which includes an oil cooler which is integrated therewith.

2. Description of the Prior Art

In currently used 'water cooled' internal combustion engine such as shown in FIG. 1 of the drawings, the engine coolant (liquid) is forcefully circulated by a water pump, through a cooling circuit including the engine coolant jacket and an air cooled radiator. This type of system encounters the drawback that a large volume of water is required to be circulated between the radiator and the coolant jacket in order to remove the necessary amount of heat. Further, due to the large mass of water inherently required, the warm-up characteristics of the engine are undesirably sluggish. For example, if the temperature difference between the inlet and discharge ports of the coolant jacket is 4 degrees, the amount of heat which 1 Kgm of water may effectively remove from the engine under such conditions is 4 Kcal. Accordingly, in the case of an engine having 1800 cc displacement (by way of example) is operated full throttle, the cooling system is required to remove approximately 4000 Kcal/h. In order to achieve this, a flow rate of 167 liter/min (viz., $4000-60\times\frac{1}{4}$) must be produced by the water pump. This of course undesirably consumes a number of useful horsepower. Further, in the event that a water cooled oil cooler is integrated with this type of cooling system, the work required to force the coolant through the conduiting and heat exchanger of the same, only adds to parasitic losses encountered by the circulation pump.

FIG. 2 shows an arrangement disclosed in Japanese Patent Application Second Provisional Publication Sho. No. 57-57608. This arrangement has attempted to vaporize a liquid coolant and use the gaseous form thereof as a vehicle for removing heat from the engine. In this system the radiator 1 and the coolant jacket 2 are in constant and free communication via conduits 3, 4 whereby the coolant which condenses in the radiator 1 is returned to the coolant jacket 2 little by little under the influence of gravity.

This arrangement has suffered from the drawbacks that the radiator, depending on its position with respect to the engine proper, tends to be at least partially filled with liquid coolant. This greatly reduces the surface area via which the gaseous coolant (for example steam) can effectively release its latent heat of vaporization and accordingly condense, and thus has lacked any notable improvement in cooling efficiency.

Further, with this system in order to maintain the pressure within the coolant jacket and radiator at atmospheric level, a gas permeable water shedding filter 5 is arranged as shown, to permit the entry of air into and out of the system. However, this filter permits gaseous coolant to gradually escape from the system, inducing the need for frequent topping up of the coolant level.

A further problem with this arrangement has come in that some of the air, which is sucked into the cooling system as the engine cools, tends to dissolve in the water, whereby upon start up of the engine, the dissolved air tends to form small bubbles in the radiator which adhere to the walls thereof forming an insulating layer. The undissolved air also tends to collect in the upper section of the radiator and inhibit the convention-like circulation of the vapor from the cylinder block to the radiator. This of course further deteriorates the performance of the device.

European Patent Application Provisional Publication No. 0 059 423 published on Sept. 8, 1982 discloses another arrangement wherein, liquid coolant in the coolant jacket of the engine, is not forcefully circulated therein and permitted to absorb heat to the point of boiling. The gaseous coolant thus generated is adiabatically compressed in a compressor so as to raise the temperature and pressure thereof and thereafter introduced into a heat exchanger (radiator). After condensing, the coolant is temporarily stored in a reservoir and recycled back into the coolant jacket via a flow control valve.

This arrangement has suffered from the drawback that air tends to leak into the system upon cooling thereof. This air tends to be forced by the compressor along with the gaseous coolant into the radiator. Due to the difference in specific gravity, the air tends to rise in the hot environment while the coolant which has condensed moves downwardly. Accordingly, air, due to this inherent tendency to rise, forms pockets of air which cause a kind of 'embolism' in the radiator and badly impair the heat exchange ability thereof.

U.S. Pat. No. 4,367,699 issued on Jan. 11, 1983 in the name of Evans (see FIG. 3 of the drawings) discloses an engine system wherein the coolant is boiled and the vapor used to remove heat from the engine. This arrangement features a separation tank 6 wherein gaseous and liquid coolant are initially separated. The liquid coolant is fed back to the cylinder block 7 under the influence of gravity while the 'dry' gaseous coolant (steam for example) is condensed in a fan cooled radiator 8. The temperature of the radiator is controlled by selective energizations of the fan 9 to maintain a rate of condensation therein sufficient to maintain a liquid seal at the bottom of the device. Condensate discharged from the radiator via the above mentioned liquid seal is collected in a small reservoir-like arrangement 10 and pumped back up to the separation tank via a small constantly energized pump 11.

This arrangement, while providing an arrangement via which air can be initially purged to some degree from the system tends to, due to the nature of the arrangement which permits said initial non-condensible matter to be forced out of the system, suffer from rapid loss of coolant when operated at relatively high altitudes. Further, once the engine cools air is relatively freely admitted back into the system.

The provision of the separation tank 6 also renders engine layout difficult in that such a tank must be placed at relatively high position with respect to the engine, and contain a relatively large amount of coolant so as to buffer the fluctuations in coolant consumption in the coolant jacket. That is to say, as the pump 11 which lifts the coolant from the small reservoir arrangement located below the radiator, is constantly energized (apparently to obviate the need for level sensors and the like arrangement which could control the amount of coolant returned to the coolant jacket) the amount of coolant stored in the separation tank must be sufficient as to allow for sudden variations in the amount of coolant consumed in the coolant jacket due to sudden changes in the amount of fuel combusted in the combustion chambers of the engine.

This reference discloses the provision of a heat exchanger between the engine lubrication system and the cooling system. However, the function of the device is primarily one of heating the lubricant rather than cooling same.

Japanese Patent Application First Provisional Publication Sho. No. 56-32026 (see FIG. 4 of the drawings) discloses an arrangement wherein the structure defining the cylinder head and cylinder liners are covered in a porous layer of ceramic material 12 and coolant sprayed into the cylinder block from shower-like arrangements 13 located above the cylinder heads 14. The interior of the coolant jacket defined within the engine proper is essentially filled with only gaseous coolant during engine operation during which liquid coolant is sprayed onto the ceramic layers 12. However, this arrangement has proven totally unsatisfactory in that upon boiling of the liquid coolant absorbed into the eramic layers, the vapor thus produced and which escapes into the coolant jacket inhibits the penetration of fresh liquid coolant and induces the situation wherein rapid overheat and thermal damage of the ceramic layers 12 and/or engine soon results. Further, this arrangement is plagued with air contamination and blockages in the radiator similar to the compressor equipped arrangement discussed above.

FIG. 5 shows an arrangement which is disclosed in U.S. Pat. No. 2,844,129 issued on July 22, 1985 in the name of E. J. Beck Jr. et al. This arrangement was proposed for use in low temperature environments and includes a lubricant temperature control arrangement wherein the "relatively" warm condensate from the condensor 20 is passed through a heat exchanging device 22 immersed in the lubricating oil contained in the engine sump 24 before being returned to the coolant jacket 26 disposed about the cylinder or cylinders 28 of the engine.

This arrangement while attempting to control the temperature of the coolant has suffered from the drawback that the radiator 20 even through arranged physically above the engine proper (and as such slightly less prone to the embolism problems encountered with the previously discussed prior art) does not provide for the boiling point of the coolant in the coolant jacket 26 to be controlled in response to the engine load and further, if used in normal temperature environments and/or in high performance engines, the coolant tends to boil in the heat exchanger 22 and thus introduces bubbles of coolant vapor into the coolant jacket 26 in a manner which invites localized cavitation and dry-outs in therein and subsequent engine damage. Moreover, in the case of high performance engines the marked loss of heat exchange efficiency of the radiator 20 due to the inevitably inclusion of contaminating air invites ready overheat of the engine and lubricant.

The FIG. 5 arrangement also tends to maintain the lubricant at a temperature which is lower than that of the coolant in the coolant jacket 26 rather than at the same level which is preferable from the point of unifying the temperature of the engine as a whole.

SUMMARY OF THE PRESENT INVENTION

It is an object of the present invention to provide an evaporative type cooling system for an internal combustion engine which includes an oil cooler which is integrated with the system and which maintains the temperature of the engine lubricant in a manner which parallels the control of the engine coolant temperature.

More specifically, the present invention takes the form of a cooling system for an internal combustion engine having a structure subject to high heat flux and a lubricant system, the cooling system being characterized by a coolant jacket disposed about the structure and into which coolant is introduced in liquid form and permitted to boil; a radiator in which gaseous coolant is condensed to its liquid state; a vapor transfer conduit leanding from the coolant jacket to the radiator for transferring coolant vapor from the coolant jacket to the radiator for condensation therein; means for returning liquid coolant from the radiator to the coolant jacket in a manner to maintain the structure immersed in a predetermined depth of liquid coolant; a device associated with the radiator for varying the rate of heat exchange between the radiator and a cooling medium which surrounds the radiator; a first parameter sensor for sensing a parameter which varies with the temperature of the coolant in the coolant jacket; a second parameter sensor for sensing a parameter which varies with the load on the engine; a circuit responsive to the first and second parameter sensors for operating the device in a manner which tends to maintain the temperature of the coolant in the coolant jacket at a level determined in response to the load on the engine; a housing in fluid communication with the coolant jacket; and a heat exchanger disposed in the housing and immersed in liquid coolant, the heat exchanger being arranged to have coolant from engine lubricating system circulated therethrough.

BRIEF DESCRIPTION OF THE DRAWINGS

The features and advantages of the arrangement of the present invention will become more clearly appreciated from the following description taken in conjunction with the following drawings in which.

DETAILED DESCRIPTION OF THE PREFERRED EMBODIMENT

Before preceeding with the description of the embodiments of the present invention, it is deemed appropriate to discuss some of the features of the cooling system in which the oil cooler of the present invention is incorporated.

Figure 1:
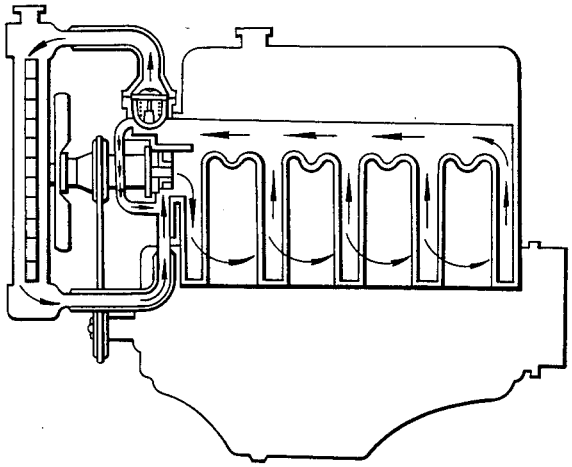
FIG.1 (PRIOR ART)
FIGS. 1 to 5 show the prior art arrangements discussed in the opening paragraphs of the instant disclosure.
Figure 2:
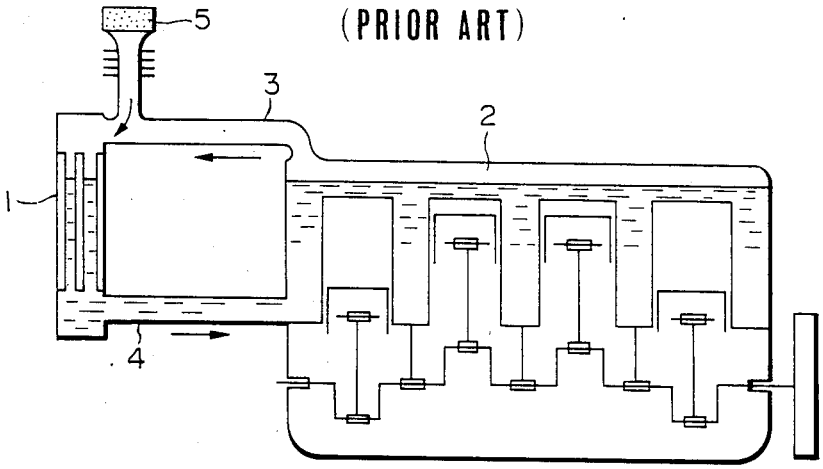
FIG.2 (PRIOR ART)
Figure 3:
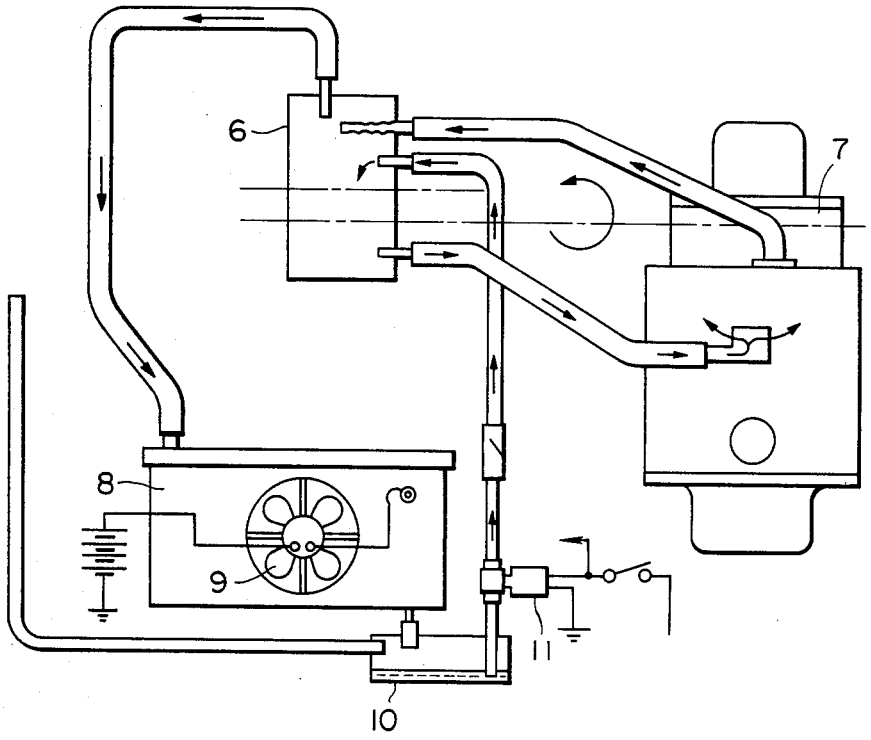
FIG.3 (PRIOR ART)
Figure 4:
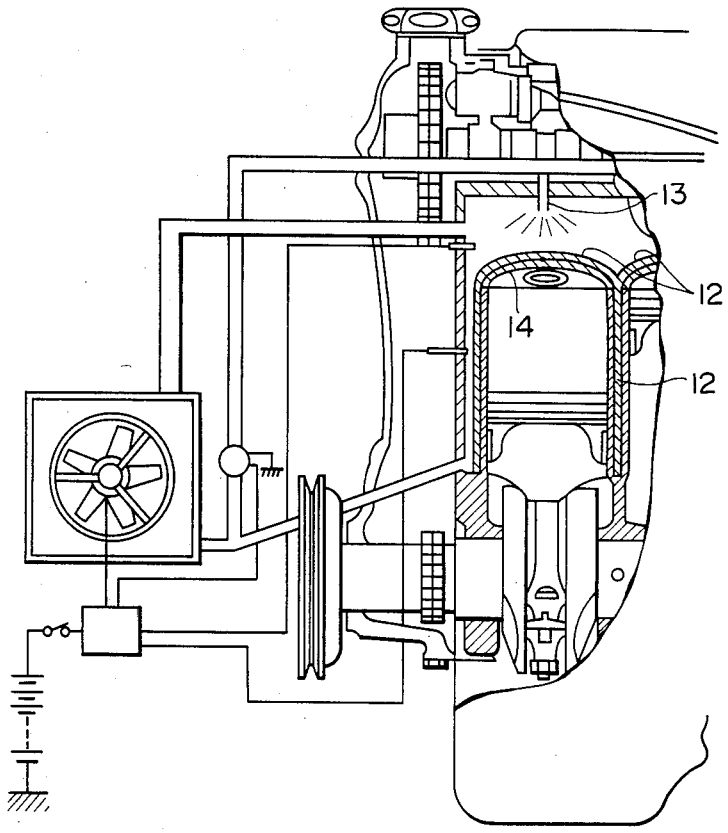
FIG.4 (PRIOR ART)
Figure 5:
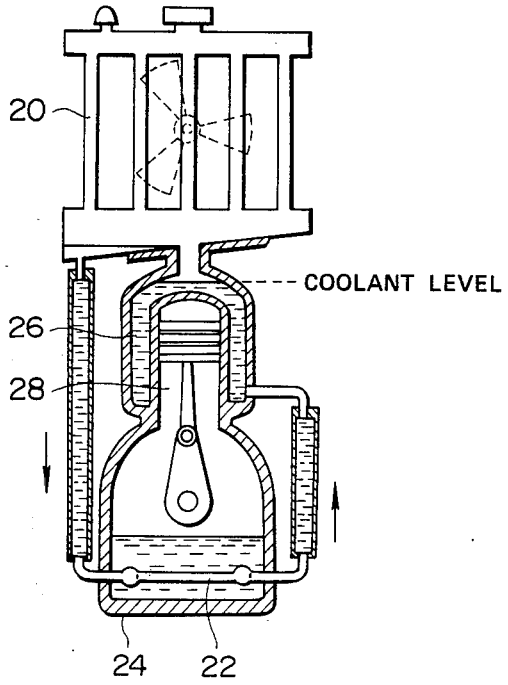
FIG. 5 (PRIOR ART)

FIG. 5 graphically shows in terms of engine torque and engine speed the various load "zones" which are encountered by an automotive vehicle engine. In this graph, the curve F denotes full throttle torque characteristics, trace L denotes the resistance encountered when a vehicle is running on a level surface, and zones I, II and III denote respectively "urban cruising", "high speed cruising" and "high load operation" (such as hillclimbing, towing etc.).

A suitable coolant temperature for zone I is approximately 110° C. while 90°-80° C. for zones II and III. The high temperature during "urban cruising" promotes improved thermal efficiency. On the other hand, the lower temperatures ensure that sufficient heat is removed from the engine and associated structure to prevent engine knocking and/or engine damage in the other zones. For operational modes which fall between the aforementioned first, second and third zones, it is possible to maintain the engine coolant temperature at approximately 100° C.

Figure 7:
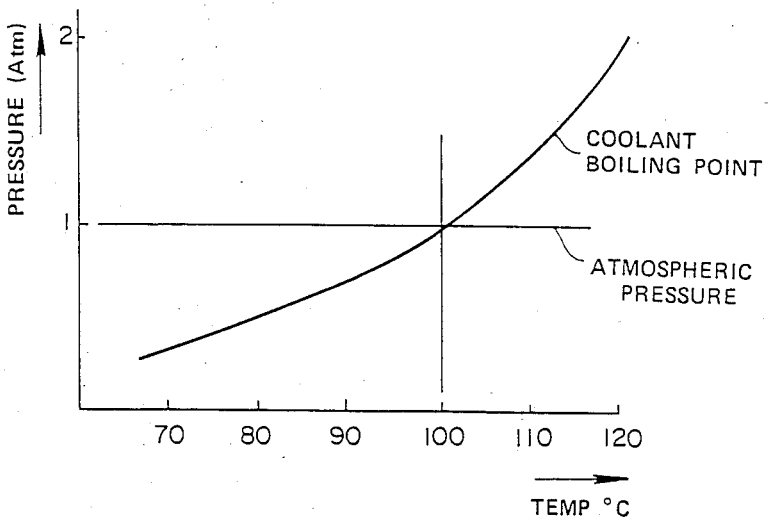
FIG. 7 is a graph showing in terms of pressure and temperature, the change which occurs in the coolant boiling point with change in pressure.

With the cooling system in which the present invention is embodied, in order to control the temperature of the engine, advantage is taken of the fact that with a cooling system wherein the coolant is boiled and the vapor used a heat transfer medium, the amount of coolant actually circulated between the coolant jacket and the radiator is very small, the amount of heat removed from the engine per unit volume of coolant is very high, and upon boiling, the pressure prevailing within the coolant jacket (and consequently the boiling point of the coolant) rises if the system employed is closed. Thus, by circulating only a limited amount of cooling air over the radiator, it is possible reduce the rate of condensation therein and cause the pressure within the cooling system to rise above atmospheric and thus induce the situation, as shown in FIG. 7, wherein the engine coolant boils at temperatures above 100° C. for example at approximately 119° C. (corresponding to a pressure of approximately 1.9 Atmospheres).

On the other hand, during high speed cruising, it is further possible by increasing the flow cooling air passing over the radiator, to increase the rate of condensation within the radiator to a level which reduces the pressure prevailing in the cooling system below atmospheric and thus induce the situation wherein the coolant boils at temperatures in the order of 80° to 90° C. However, under such conditions the tendency for air to find its way into the interior of the cooling circuit becomes excessively high and it is desirable under these circumstances to limit the degree to which a negative pressure is permitted to develop. This can be achieved by permitting coolant to be introduced into the cooling circuit from the reservoir and thus raise the pressure in the system to a suitable level.

Figure 8:
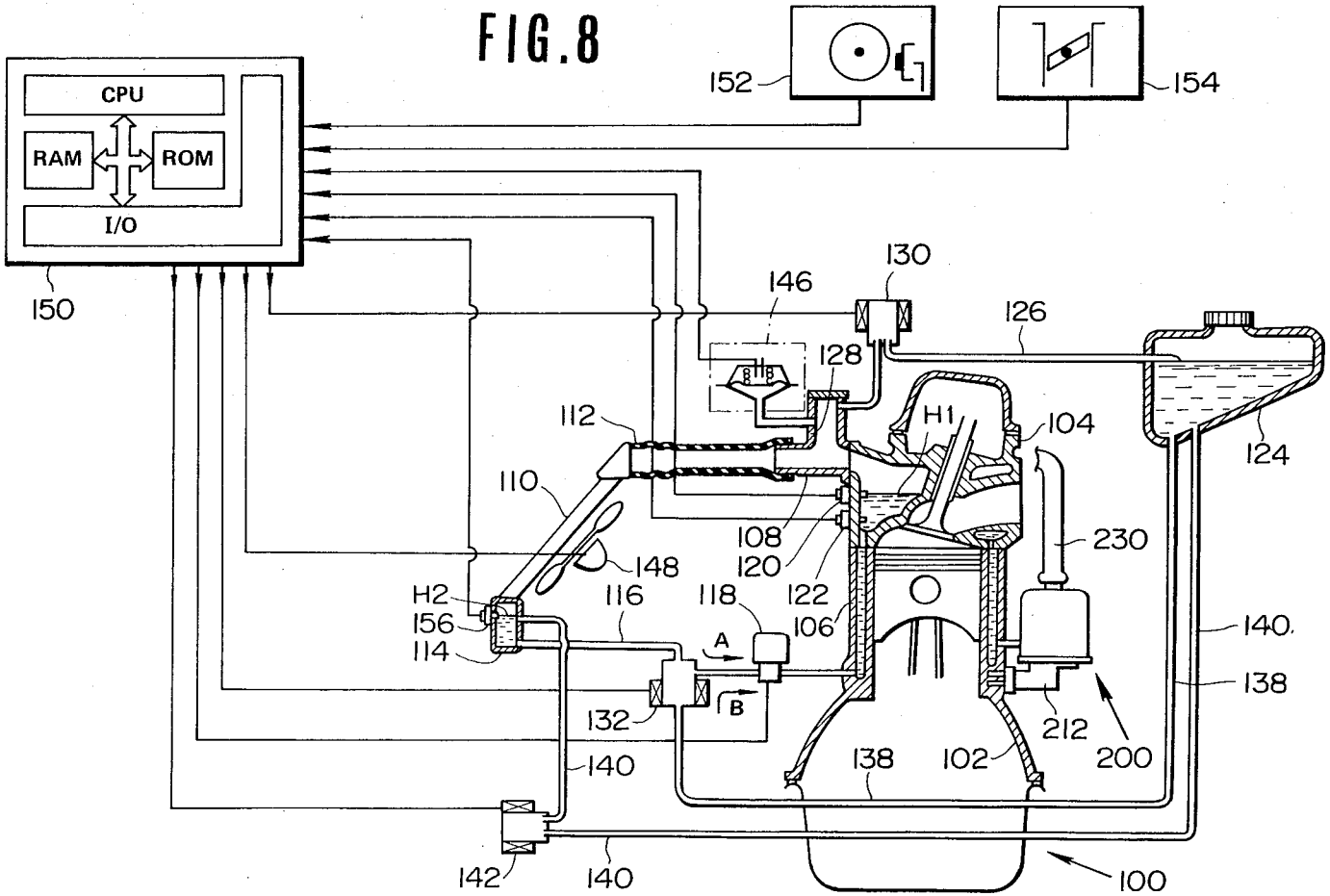
FIG. 8 shows an embodiment of the present invention.

FIG. 8 shows an embodiment of the present invention. In this arrangement an engine 100 includes a cylinder block 102 on which a cylinder head 104 is detachably mounted. The cylinder block and cylinder head are formed with cavities which define a coolant jacket 106 about the heated structure of the engine.

A vapor manifold 108 is detachably mounted on the cylinder head 104 and arranged to communicate with a condensor or radiator (as it will be referred to hereinafter) 110 via a vapor transfer conduit 112.

In this embodiment the radiator 110 comprises a plurality of relatively small diameter conduits (not shown) which terminate in a small collection vessel or lower tank 114. A coolant return conduit 116 leads from the lower tank 114 to the coolant jacket 106. In this embodiment the return conduit 116 communicates with the cylinder block 102 at a location proximate the bottom of the coolant jacket 106.

A small capacity coolant return pump 118 is disposed in conduit 116 as shown. This pump is arranged to be selectively energizable to pump coolant from said lower tank 114 toward the coolant jacket 106.

In order to control the operation of pump 118, a first level sensor 120 is disposed in the coolant jacket 106. As shown, this level sensor 120 is arranged at a level H1 which is selected to be a predetermined height above the structure which defines the cylinder heads, exhaust ports and valves of the engine (viz., structure subject to a high heat flux) so as to maintain same immersed in sufficient coolant and thus obviate the formation of localized dryouts (induced by excessively violent bumping and frothing of the coolant) and thus avoid engine damage due to localized overheating and the like. This sensor may be arranged to exhibit hysteresis characteristics so as to prevent rapid ON/OFF cycling of pump 118.

Disposed below the level sensor 120 so as to be securely immersed in liquid coolant and in relatively close proximity to the most highly heated structure of the engine is a temperature sensor 122.

A reservoir 124, the interior of which is maintained constantly at atmospheric pressure, is arranged to fluidly communicate with what shall be referred to as a "cooling circuit" (viz., a circuit comprised of the coolant jacket 106, the vapor manifold 108, the vapor transfer conduit 112 and coolant return conduit 116) via a "valve and conduit" arrangement. In this embodiment the valve and conduit arrangement comprises an overflow conduit 126 which leads from a riser 28 formed in the vapor manifold 108, a first valve 130 which normally closes the overflow conduit 126 and which permits communication between the riser 128 and the reservoir 124 upon energization; a second (three-way) valve 132 disposed in the coolant return conduit 116 at a location between the lower tank 114 and pump 118 and which has a first position wherein communication between the lower tank 114 and the pump 118 is established (flow path A) and a second position wherein communication between the reservoir 124 and pump 118 is established via a supply conduit 138 (flow path B); a fill displacement conduit 140 which leads from the reservoir 124 to the lower tank 114; and a third valve 142 which permits communication between the lower tank 114 and the reservoir 124 when de-energized and which cuts-off said communication upon energization.

In order to sense the pressure prevailing in the cooling circuit a pressure differential responsive switch arrangement 146 is arranged to communicate with the riser 128 as shown. This switch is arranged to be triggered to output a signal upon the pressure in the vapor manifold 108 dropping a predetermined amount below ambient atmospheric pressure.

A small electric fan 148 (or like device) is disposed beside the radiator 110 and arranged to force a draft of air over the surface thereof and thus induce an increase in the heat exchange between the radiator and the surrounding atmospheric air.

A control circuit 150 which in this embodiment includes a microprocessor comprising a CPU, a RAM a ROM and an in/out interface I/O is arranged to receive inputs from temperature sensor 122 and level sensor 120. This circuit also receives data inputs from an engine speed sensor 152, a engine load sensor 154 and a second level sensor 156 disposed in lower tank 114 at a level essentially equal to that at which the fill/discharge conduit 140 communicates with same.

The ROM of the microprocessor contains various control programs which are used to control the operation of the fan 148, pump 118 and valves, and of the valve and conduit arrangement. These programs will be discussed in detail hereinlater.

In order to control the temperature of the engine lubricant in a manner which quickly raises the temperature thereof during cold engine starts to a level whereat efficient lubrication characteristics are obtained and to subsequently prevent the temperature of the lubricant from rising to a level whereat rapid degradation occurs, a lubricant temperature control device or oil cooler 200 (as it will be referred to hereinafter) is integrated into the engine cooling system.

Figure 9:
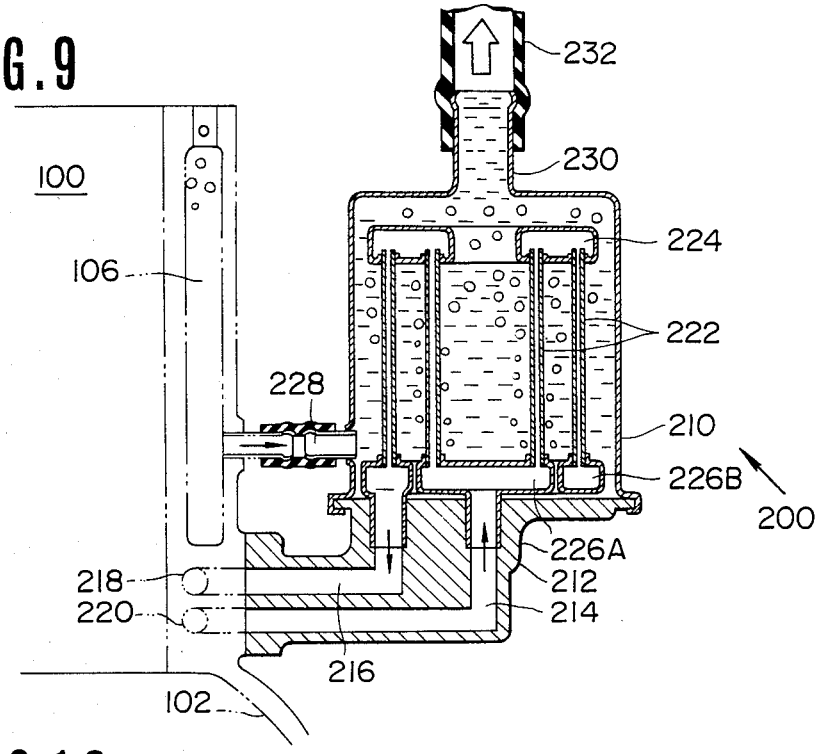
FIG. 9 shows in sectional elevation the oil cooler of the first embodiment.

As best seen in FIG. 9, the oil cooler of the first embodiment includes a bell-shaped housing member 210 secured atop of a base member 212 which is attached to the side of the cylinder block 102. The base member 212 is formed with bores which define oil inlet and exhaust passages 214 and 216. As shown, these passages are arranged to communicate with corresponding passages 218, 220 bored into the cylinder block 102.

Disposed within the bell-shaped housing member 210 is a heat exchanging arrangement comprised of upper and lower tanks interconnected by a plurality of relatively small diameter pipes 222. As shown, the upper tank 224 is essentially annular in shape while the lower tank arrangement is divided into two sections. The first section 226A is essentially circular in shape and arranged to communicate with inlet passage 214 while the second section 226B which is disposed about the first one, is essentially annular and arranged to communicate with the exhaust passage 216. With this arrangement the oil freshly supplied from the sump (for example) is introduced into the circular section 226A, passed upwardly through some of the pipes 222 to the upper annlar tank 226B and thereafter back down to the outer annular shaped tank section 226B via the remaining pipes. Subsequently, it is returned to the engine sump (or the like) via conduit 220.

In the first embodiment the oil cooler 200 is disposed at a relatively low position on the engine (viz., at a level below level H1) and to arranged communicate with the coolant jacket 106 via a coolant introduction conduit 228. The top of the bell-shaped housing member 210 is provided with a large diameter connection nipple 230 which communicates with a section of the coolant jacket 106 which above level H1 via a connection conduit 232. This conduit functions to transfer any coolant vapor generated via the heat exchange between the engine lubricant and the liquid coolant contained in the bell-shaped housing member 210, into the vapor collection space defined within the upper section of the coolant jacket 106 or directly into the vapor manifold 108.

The operation of the above described arrangement is such that if the engine is subject to a cold start whereat the temperature of both of the coolant and the lubricant is at a low level, as the engine coolant heats toward its boiling point, the temperature of the lubricant being passed through the heat exchanging arrangement included in the oil cooler is also heated toward a temperature whereat the viscousity etc., of the oil tend toward their optimum values. This rapid warming of the engine lubricant is highly beneficial from the point of reducing engine wear and the like which tends to be relatively high while the engine is cold and the lubricant relatively viscous. This in combination with the rapid warming of the engine as a whole possible with the cooling system, rapidly brings the temperature of the engine up to a level whereat efficient combustion and lubrication are possible thus lowering undesirable HC emissions and simultaneously obviating rapid wear of the engine. Further, once the engine and lubricant are warmed, the temperature of the lubricant can be prevented from rising excessively and undergoing rapid degredation and/or causing damage to heat sensitive bearing metals and the like. Viz., as the oil is being circulated through the oil cooler the heat from the same can be transferred to the coolant in the bell-shaped housing member 210 and upon sufficient heat being absorbed by the coolant, the resulting coolant vapor is allowed to bubble up through the connection nipple 230, and pass through conduit 232 to the vapor collection space or the vapor manifold wherein it blends with the vapor produced by the coolant in the coolant jacket 106.

With the present invention it will be noted that the temperature of the lubricant is varied with the load on the engine. Viz., subject to the same control as the coolant in the coolant jacket. Thus, when the engine is subject to "urban cruising" the temperature of the oil tends to raised as compared with when the engine is operated under high load conditions. Accordingly, the temperature of the engine tends to be unified under all modes of engine operation.

Alternatively, in lieu of bringing the oil to be cooled directly from the engine sump it is possible to circulate the oil from the torque converter and/or hydraulic control circuit of an automatic transmission through the oil cooler and returning same to the sump for further recirculation and thus, take full advantage of the high heat removal capacity of the colling system into which the oil cooler of the present invention is integrated.

Figure 10:
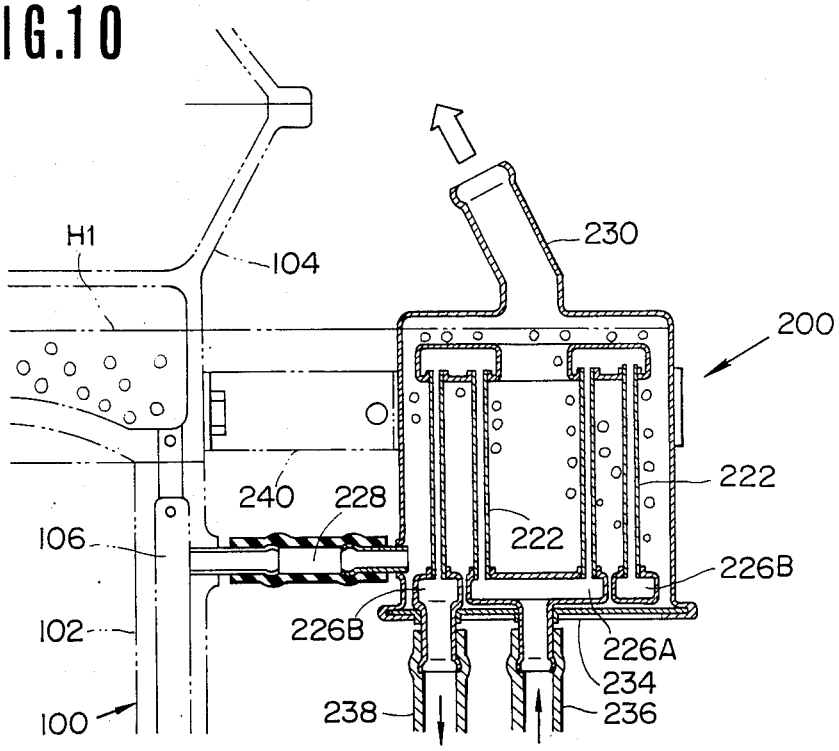
FIG. 10 shows in sectional elevation an oil cooler arrangement which characterizes a second embodiment of the present invention.

FIG. 10 shows a second embodiment of the present invention. This arrangement is basically the same as the first one and differs in that the position of the oil cooler is raised so that the top of the bell-shaped housing member is located just above level H2 and so that the top of the heat exchanging arrangement of the oil cooler is below said level and thus completely immersed in liquid coolant. With this arrangement a small vapor collection space is defined within the oil cooler so as to allow for any bumping and or frothing of the coolant which may occur when higly heated lubricant is passed through the device.

Further differences come in that the base member of the first embodiment is replaced by a closure plate 234, in that the communication between the engine lubricating system and the oil cooler is established via flexible conduits 236 and 238 and in that the oil cooler is supported on the engine by a bracket 240.

It will be noted that the interior of the bell-shaped housing member 210, and conduits 228, 232 form part of the previously mentioned "cooling circuit".

Prior being put into use it is necessary to completely fill the "cooling circuit" with coolant and displace any non-condensible matter. To do this it is possible to remove the cap (no numeral) which closes the riser 128 and manually fill the system with liquid coolant (for example water or a mixture of water and anti-freeze). Alternatively, or in combination with the above, it is possible to introduce excess coolant into reservoir 124, condition valve 132 to produce flow path B, and energize pump 118 until such time as coolant may be visibly seen spilling out of the open riser 128. By securing the cap in place at this time it is possible to hermetically seal the system in a completely filled condition.

Figure 11:
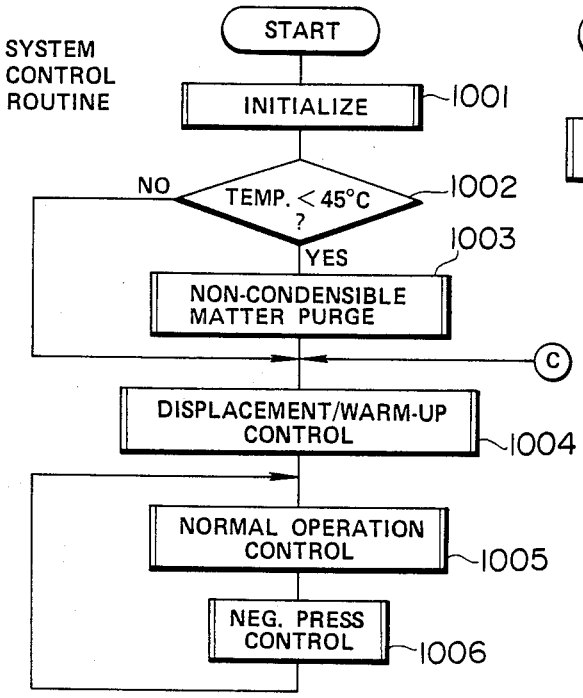
FIGS. 11 to 17 show flow charts which depict the operations which characterize the operation of the arrangement shown in FIG. 8.

FIG. 11 shows in flow chart form a control routine which manages the overall operation of the cooling system shown in FIG. 8. As shown, subsequent to start of the engine and initialization of the system, the coolant temperature is determined by sampling the output of temperature sensor 122 at step 1002. In the event that the coolant temperature is below a predetermined level ($T_L$) which in this case is selected to be 45° C., the control program flows to step 1003 wherein a non-condensible matter purge sub-routine is run. However, if the temperature is above 45° C. then the program bypasses the purge operation and proceeds directly to step 1004 on the assumption that as the coolant is still warm, the engine has not been stopped long and there has been insufficient time for atmospheric air or the like to have leaked into and contaminated the cooling circuit of the engine.

At step 1004 a warm-up/displacement mode of operation is entered. During this routine any excess coolant which has entered the cooling circuit while the engine was stopped is displaced until (a) the coolant boils at a temperature which is deemed appropriate for the instant mode of engine operation or (b) a minimum amount of coolant (viz., the coolant in the coolant jacket 106 and lower tank 114 both assume level H1 and H2 respectively) is retained in the cooling circuit.

Figure 17:
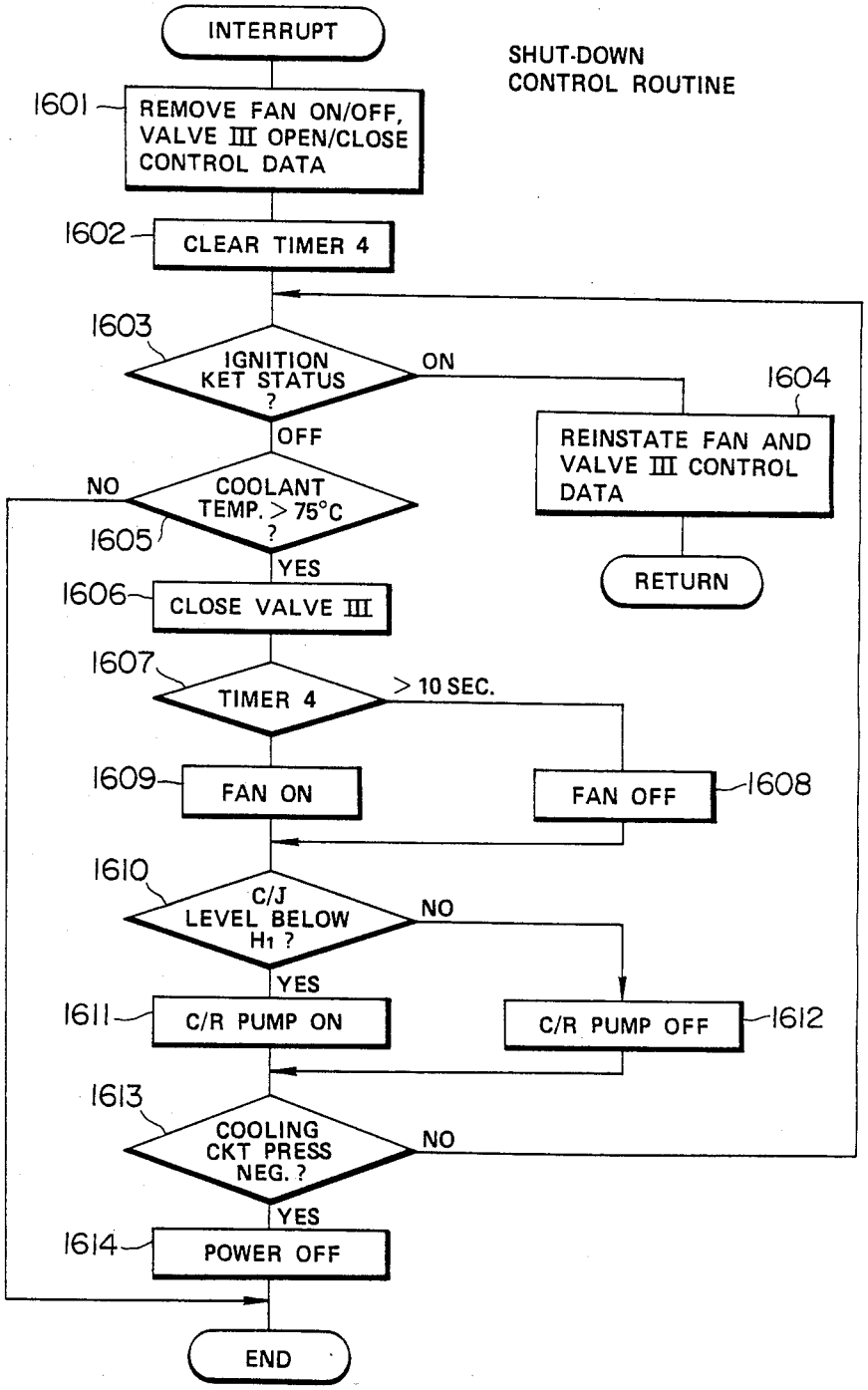

It should be noted that when the engine is stopped and has assumed a predetermined condition under the control of a 'shut-down' control routine (described in detail hereinlater with reference to FIG. 17) that liquid coolant from the reservoir 124 is permitted to be introduced into the coolant circuit under the influence of the pressure differential which develops as the coolant vapor condenses to its liquid state. Accordingly, depending on the temperature of the coolant and the amount of coolant vapor which remains in the cooling circuit, the latter will tend to be partially to completely filled with liquid coolant.

Following the coolant displacement the control program flows to step 1005 wherein a normal operation control routine is entered. This routine controls the operation of the various elements of the cooling system in a manner to vary the temperature according to engine load and/or other parameters and to ensure that the level of coolant in the coolant jacket is maintained at a level sufficient to adequately immerse the highly heated engine structure in a predetermined depth of liquid coolant.

In the event that the pressure within the cooling circuit falls due to external influences such as ambient temperature, humidity and the like, a negative pressure control routine (step 1006) is executed, while in the event that inclusion of pockets of contaminating non-condensible matter or the like induces the coolant temperature to rise above the control possible with the normal operation routine an abnormally high pressure control routine is run.

In order to determine if the engine steps or is stopped, an interrupt (step 1101—FIG. 8) is carried out at predetermined time intervals or periods to break into the current control routine and determine the need to execute a shut-down control routine (step 1102).

Each of the above mentioned routines will now be discussed with reference to FIGS. 11 to 17.

NON-CONDENSIBLE MATTER PURGE CONTROL ROUTINE

Subsequent to the decision that the coolant temperature is below a temperature at which a so called "warm start" can be performed (viz., the engine has not cooled sufficiently after use that any particular quantity of air or the like is likely to have entered the cooling circuit), a non-condensible matter purge is carried out to ensure that any air or the like is removed before the system is put in normal operation. At step 1201 of this routine, valves 130, 142 and 132 are conditioned as shown.

For ease of explanation, a convention wherein the valves are referred to accordingly to their physical height on the embodiment illustrated in FIG. 8 will be used. Viz., valve 130 being the highest will be referred to valve I; three-way valve 132 being located at a level between valves 130 and 142 will be referred to as valve II; and valve 142 as valve III.

At step 1202 the coolant return pump 122 (C/R pump) is energized. Under these conditions as valve II (132) is conditioned to establish flow path B the pump 118 inducts coolant from the reservoir 124 via the induction conduit 138 and introduces same into the coolant jacket 106 via coolant return conduit 116. As valve I (130) is open at this time any excess coolant which may tend to accumulate in the cooling circuit is able to overflow back to the reservoir 124 through conduit 126. To ensure that pump 122 is operated sufficiently to completely clear the cooling circuit of air bubbles and the like the purge routine at step 1203 a "soft" clock or the like is set counting. In this embodiment the clock (Timer 1) is arranged to count for a predetermined period which can vary from several tens of seconds to one or even several minutes. Upon completion of the count pump 118 is stopped (step 1204) and at step 1205 the soft clock (Timer 1) is cleared ready for the next run.

COOLANT DISPLACEMENT/WARM/UP CONTROL ROUTINE

Figure 14A:
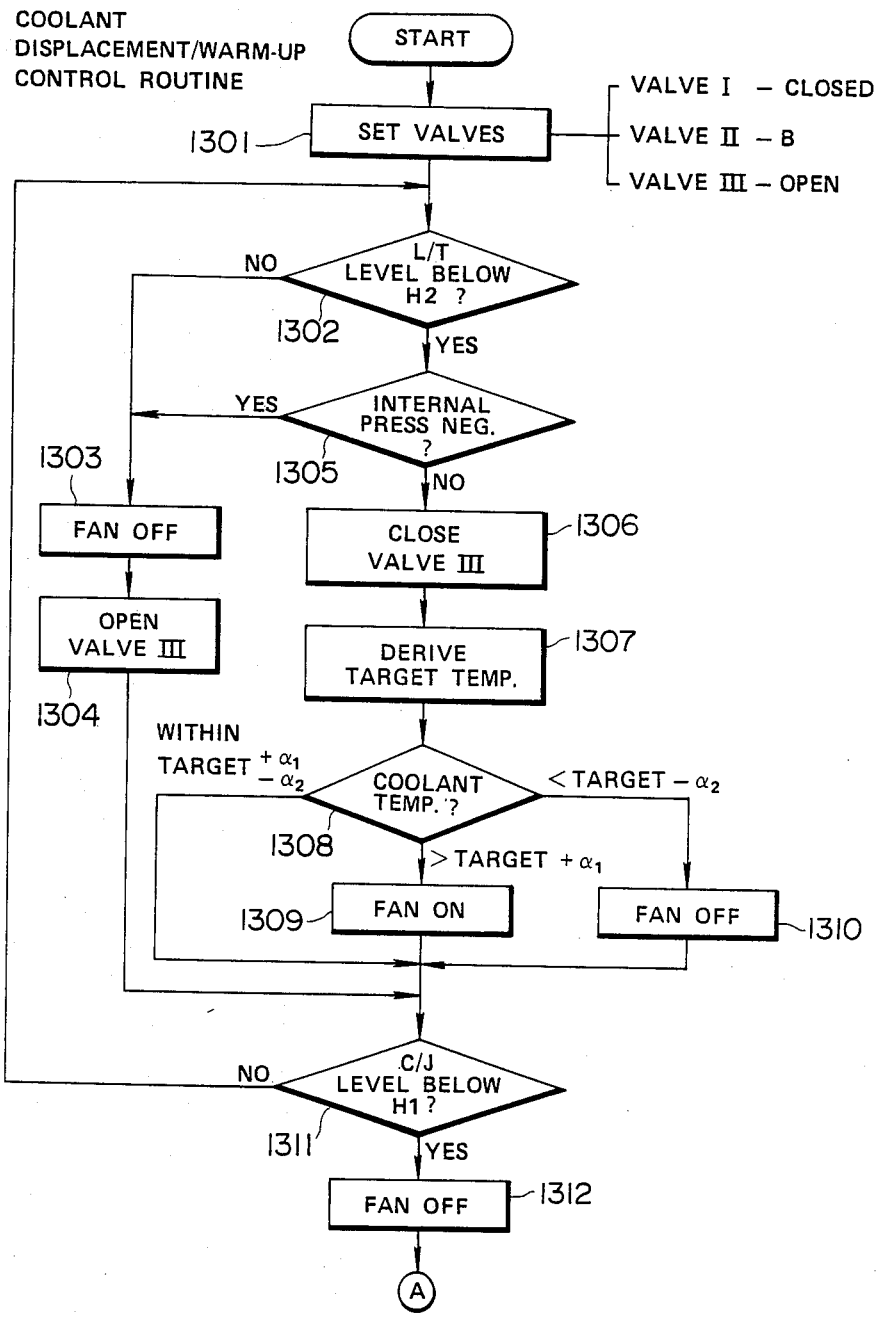
Figure 14B:
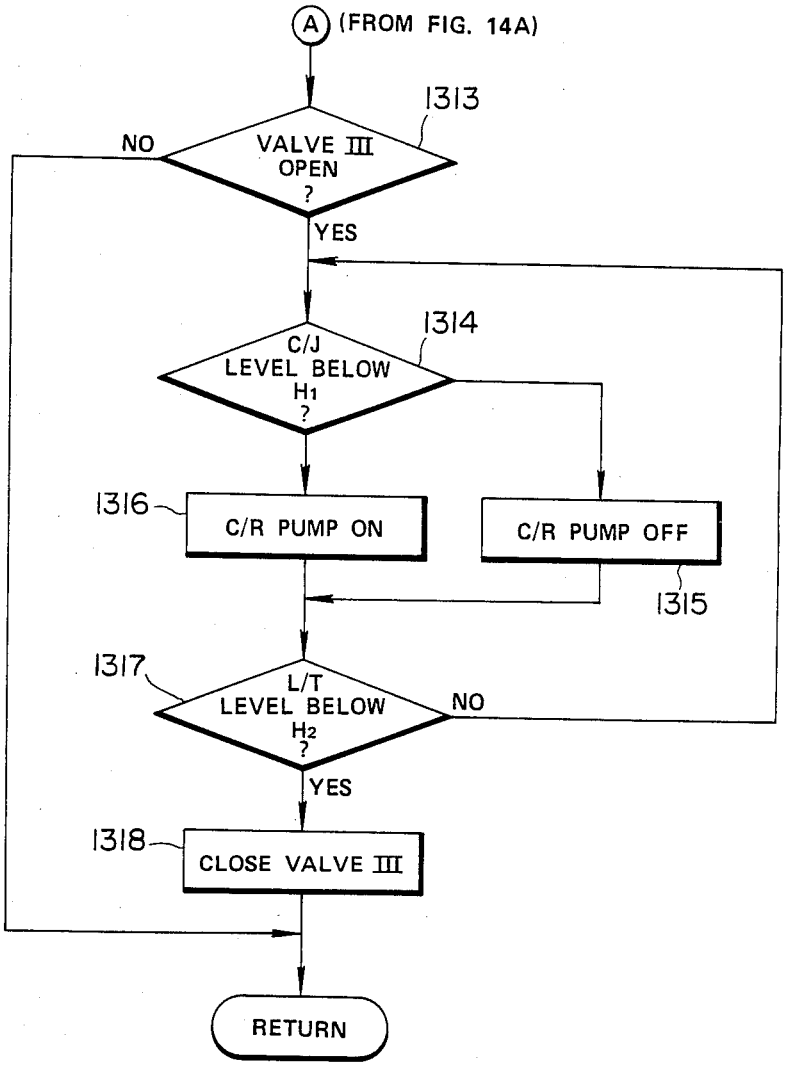
Figure 15A:
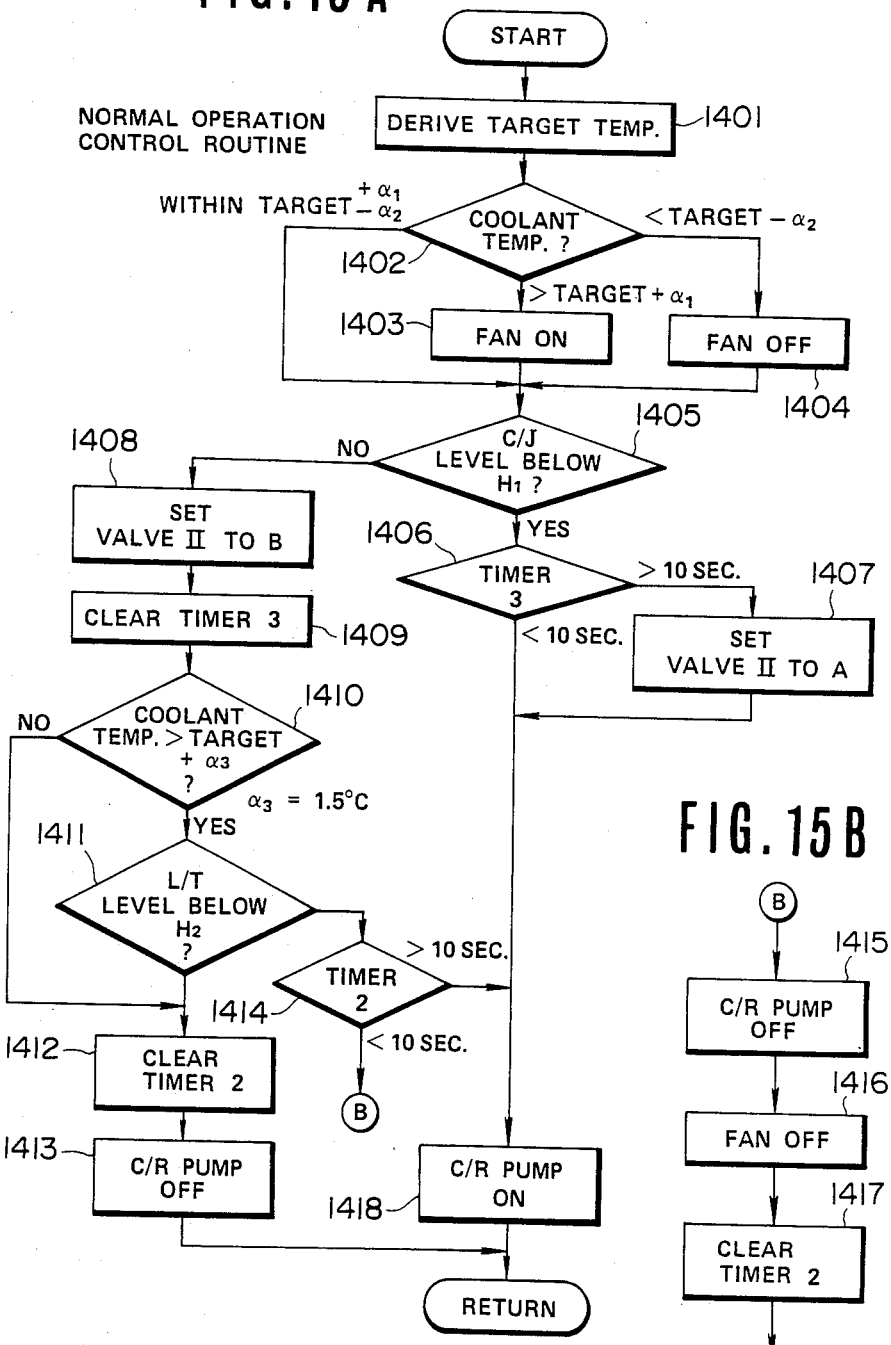
Figure 15B:
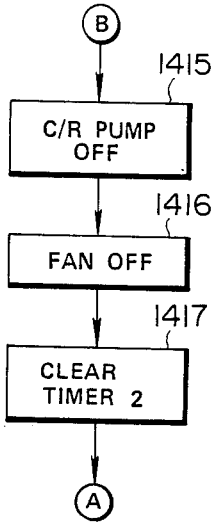

FIGS. 14A to 14B show the steps which characterize the warm-up and displacement of the coolant contained in cooling circuit. As mentioned previously, this routine can be executed either after a non-condensible matter purge or in the event that the coolant temperature is above the predetermined temperature utilized at step 1002.

At step 1301 valves I, II and III are conditioned as shown. That is to say, valve I is closed, three-way valve is conditioned to establish flow path B and the lowermost valve 142 opened. At step 1302 it is determined if the level of coolant in the lower tank 114 is above or below level H2. This of course can be determined by sampling the output of level sensor 156. In the event that the level of coolant is above H2 then at step 1303 the operation of the fan 148 is prevented and at step 1304 a command to open valve III issued.

If the outcome of the inquiry carried out at step 1302 indicates that the level of coolant in the lower tank 114 is at or below level H2 then at step 1305 the output of the pressure differential switch arrangement 146 is sampled to determined if the pressure prevailing within the cooling circuit is negative nor not. If the pressure has lowered to the point of being below atmospheric by a predetermined amount then the program flows to step 1303. However, if the pressure is above the lower permissible limit then at step 1306 a command to close valve III (142) is issued to prevent too much coolant from being displaced from the system and inducing a shortage of same.

Figure 6:
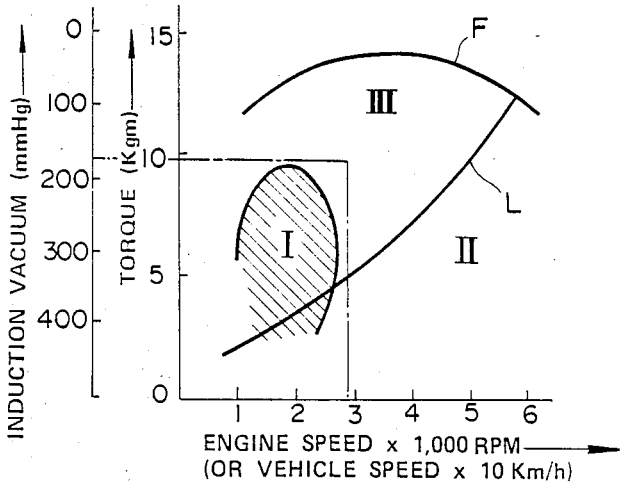
FIG. 6 is a graph showing in terms of induction vacuum (load) and engine speed the various load zones encountered by an automotive internal combustion engine.

At step 1307 the most appropriate temperature for the coolant to be maintained at in view of the instant set of operating conditions, is derived. This 'target' temperature as it will be referred to, may be derived using the inputs from sensors 152 and 154 and performing a table look-up (using a table based on the load zone chart shown in FIG. 6) or calculated using a predetermined calculation program. The various ways in which the just mentioned 'target' value can be derived will be obvious to those skilled in the art of programming given the data available in FIG. 6 and as such will not be discussed for the sake of brevity.

At steps 1308, 1309 and 1310 the temperature of the coolant is ranged and in the event that the instant coolant temperature is above the target by a value of $\alpha 1$ (wherein $\alpha 1 = 0.5°$ C.) then fan 148 is energized while if below target by the same amount then the operation of the fan is stopped.

At step 1311 the output of coolant level sensor 120 is sampled and in the event that the level of coolant in the coolant jacket 106 is still above H1 then the program flows back to step 1302 to allow for more of the excess coolant to be displaced out of the cooling circuit to the reservoir 124. However, if the coolant level is at H1 then the operation of the fan 148 is stopped (step 1312) and the program flows to step 1313 (see FIG. 14B) wherein it is determined if the valve III is open or not. In the event that this valve is not open, then the program by-passes steps 1314 to 1318 and returns. However, in the event that valve III is still open then it is necessary to ensure that the level of coolant in the coolant jacket 106 remains at the desired level H1 and thus the steps 1314, 1315 and 1316 are executed. At step 1314 the level of coolant in the lower tank 114 is determined by sampling the output of level sensor 156. If the level of coolant is still above H2 then it is assumed that it is still possible to discharge further coolant and accordingly the program recycles to step 1314. However, if the level in the lower tank 114 is at H2 then the possibility of over-discharging coolant is deemed possible and accordingly at step 1318 valve III (142) is closed leaving the system in condition for control under the "normal operation condition routine".

NORMAL OPERATION CONTROL ROUTINE

The first step (1401) of this routine invovles determining the target temperature at which the coolant in the coolant jacket 106 should be controlled to. This derivation is conducted in a manner similar to that described in connection with step 1307 (see FIG. 14A). At steps 1402, 1403 and 1404, the instant coolant temperature is ranged against the value derived in step 1401. In the event that the temperature is above target by 0.5° C. then the operation of the cooling fan 148 is induced while if below target by the same degree then the operation of the fan is stopped.

At step 1405 the level of coolant in the coolant jacket 106 is determined and in the event that the level is below H1 then valve II is conditioned to produce flow path A for a predetermined period of time (in this case ten seconds—see steps 1406 to and 1407). However, in the event that the level of coolant in coolant jacket 106 is above level H1 then the program goes to step 1408 wherein valve II is conditioned to produce flow path B. At step 1409 the timer which holds valve II conditioned to produce flow path A (viz., timer 3—step 1406) is cleared and at step 1410 the instant coolant temperature compared with a value equal to target$+\alpha 3$ (where $\alpha 3 = 1.5°$ C.). If this enquiry reveals that the instant coolant temperature does not exceed the just mentioned value then step 1411 is by-passed, timer 2 is cleared (step 1412) and coolant return pump 118 stopped (step 1413). However, if the comparison reveals that the instant coolant temperature is above said value, then at step 1414 timer 2 is set counting for a period time (in this case ten seconds). Until timer 2 completes its count the program is caused to flow to steps 1415 to 1417 and thereafter back to step 1004 (FIG. 11) to re-enter the displacement/warm-up routine.

Upon completion of the count (10 seconds) timer 2 permits the program flow to step 1418 wherein the coolant circulation pump 118 is stopped. The program then returns.

NEGATIVE PRESSURE CONTROL ROUTINE

Figure 16:
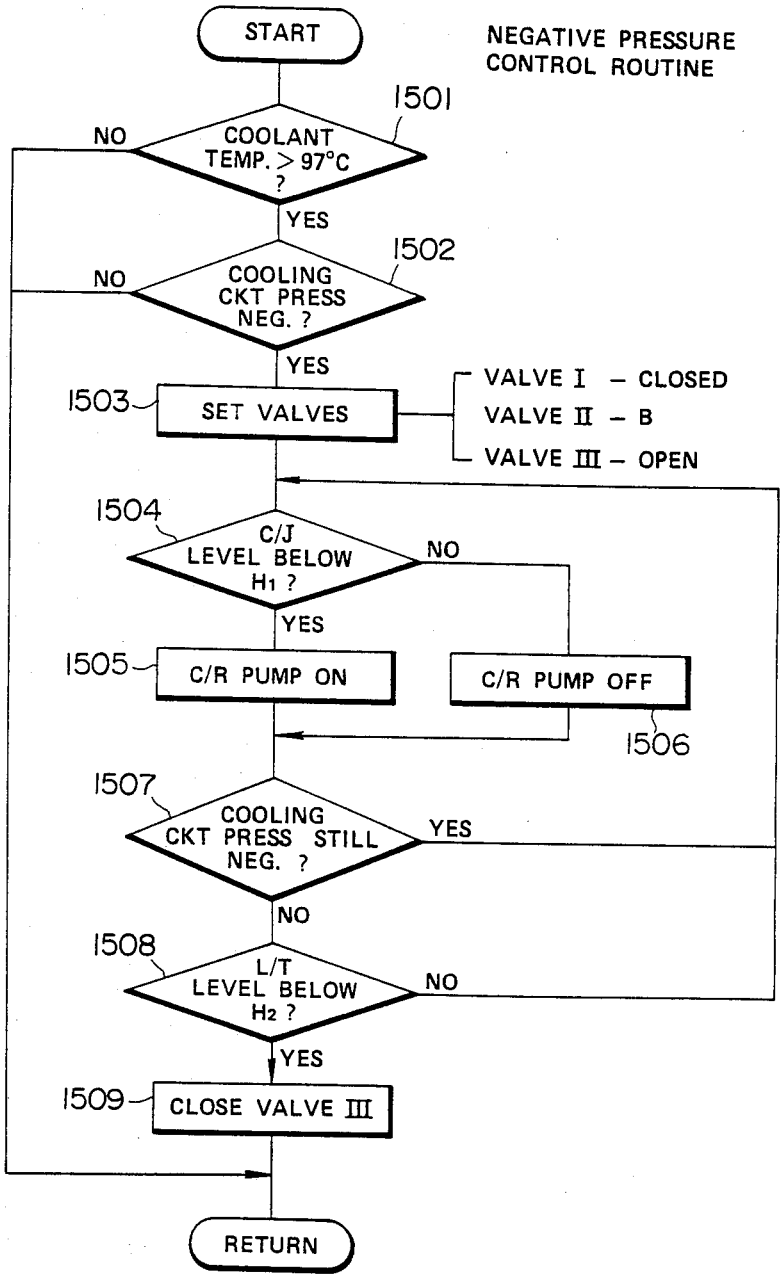

FIG. 16 shows the steps which characterize the control which is effected with the present invention in the event that due to external influences in particular, the rate of condensation in radiator 110 exceeds that which can be controlled only by stopping the operation of fan 148.

As shown, subsequent to the start of this routine the instant coolant temperature is determined by sampling the output of temperature sensor 122 (step 1501). In the event that the temperature is greater 97° C. then the routine is by-passed and the program returns. However, if the outcome of step 1501 is such as to indicate that the coolant is boiling at a temperature lower than 97° C. the program flows to step 1502 whereat the pressure prevailing in the cooling circuit with respect to the instant atmospheric pressure is determined by sampling the output of the pressure differential responsive switch arrangement 146. In the event that the pressure within the system is super-atmospheric then the remaining steps of the routine are by-passed as shown. However, if the pressure within the cooling circuit is in fact sub-atmospheric then at step 1503 valves I, II and III are conditioned as shown. In this state the system is conditioned to permit coolant to be inducted from the reservoir 124 into the radiator 110 via fill/discharge conduit 140 and lower tank 114 in a manner to simultaneously raise the pressure toward atmospheric and reduce the surface area of the radiator 110 via which the latent heat of evaporation of the gaseous coolant can be released to the ambient atmosphere.

At steps 1504, 1505 and 1506 the level of coolant in the coolant jacket is controlled to level H1 in a manner described hereinbefore. At steps 1507 and pressure prevailing in the cooling circuit is again sampled and in the event that a negative pressure still exists therein the program recycles to step 1504. However, in the event that the pressure in the system has risen to atmospheric then at step 1508 the level of coolant in the lower tank 114 is determined and if the level therein is above H2 the program recycles to step 1504 to provide further time for the excess coolant introduced into the radiator 110 to be re-displaced. Upon the pressure and temperature in the system rising back up to acceptable levels valve III is closed in step 1509 to seal the system and place same in a closed circuit condition.

In summary, upon an "overcool" condition of the cooling system occurring, the system is placed in an "open" circuit condition to permit additional coolant to be inducted into the system from reservoir 124 under the influence of the negative pressure. This measure increases the pressure in the system and reduces the heat exchange efficiency of the radiator 110. This open circuit state is maintained until such time as the engine is stopped or the overcooled condition ceases to exist.

SHUT-DOWN CONTROL ROUTINE

Figure 12:
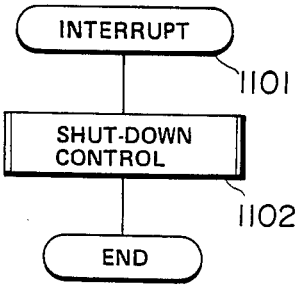
Figure 13:
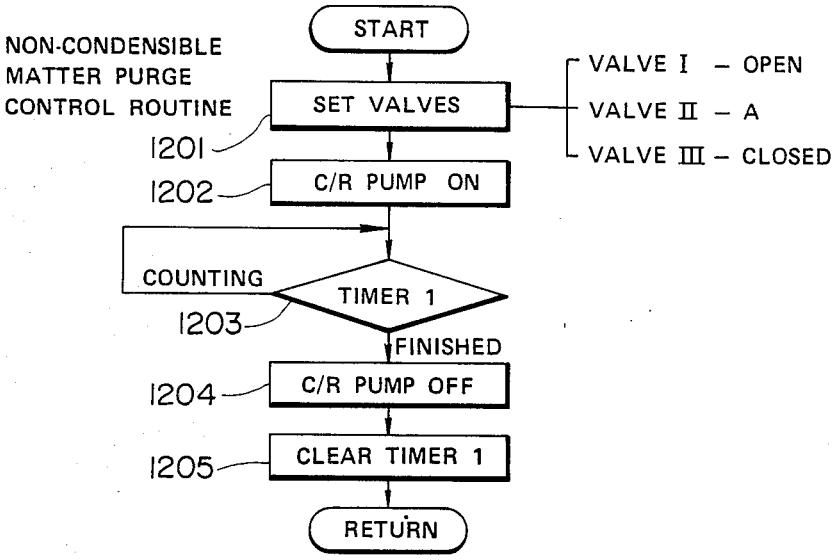

In the event that the engine stops it is necessary to interrupt the currently run control routine and implement a control which monitors the cooling of the engine and implements suitable measures in accordance with the sensed condition of the cooling system. Accordingly, the interrupt shown in FIG. 12 is executed at regular intervals. At step 1701 the current fan and valve control data is removed from the CPU and at step 1602 and a software clock "timer 4" is cleared ready for shut-down control. However, as it is possible that the engine may have simply stalled and is in the process of being restarted, the status of the ignition switch is sampled at step 1703. In the event that the ignition switch is still ON it is assumed that the engine has only temporarily stoped and the program flows to step 1704 wherein the fan and valve control data is retrieved from RAM and placed back in the microprocessor CPU. Following this the program returns and a suitable control program re-entered.

On the other hand, if the outcome of the ignition switch enquiry reveals that the switch is OFF (indicating that the engine has been deliberately stopped) the program flows to step 1605 wherein the instant coolant temperature is sampled. If the temperature is below 75° C. then it is possible to switch the cooling circuit to an open circuit condition by opening valve III (via de-energization) without encountering the problem wherein superatmospheric pressures cause violent discharge of excessive amounts of coolant and the program proceeds directly to step 1614 wherein the power to the control circuit and associated elements is cut-off.

However, while the temperature in the coolant jacket is still in excess of 75° C. it is deemed necessary to perform a "cool-down" control which involves ensuring that valve III is closed and that the fan 148 is operated intermediately (for example 10 seconds at at time) while simultaneously ensuring that the a minimum level of coolant is maintained in the coolant jacket to securely immerse the highly heated structure of the engine. As will be appreciated, upon one of (a) the pressure in the system becomming subatmospheric or (b) the temperature therein dropping to 75° C., the program will flow to step 1614 and the operation of the control system terminates.

What is claimed is:

1. A cooling system for an internal combustion engine having a structure subject to high heat flux and a lubricant system, comprising:

a coolant jacket disposed about said structure and into which coolant is introduced in liquid form and permitted to boil;

a radiator in which gaseous coolant is condensed to its liquid state;

a vapor transfer conduit leading from said coolant jacket to said radiator for transferring coolant vapor from said coolant jacket to said radiator for condensation therein;

means for returning liquid coolant from said radiator to said coolant jacket in a manner to maintain said structure immersed in a predetermined depth of liquid coolant;

a device associated with said radiator for varying the rate of heat exchange between the radiator and a cooling medium which surrounds said radiator;

a first parameter sensor for sensing a parameter which varies with the temperature of the coolant in said coolant jacket;

a second parameter sensor for sensing a parameter which varies with the load on the engine;

a circuit response to said first and second parameter sensors for operating said device in a manner which tends to maintain the temperature of the coolant in said coolant jacket at a level determined in response to the load on said engine;

a housing in fluid communication with said coolant jacket; and a heat exchanger disposed in said housing and immersed in liquid coolant, said heat exchanger being arranged to have lubricant from engine lubricating system circulated therethrough.

2. A cooling system as claimed in claim 1, wherein:

said coolant jacket, said radiator, said coolant return means, and said housing define a cooling circuit; and which further comprises:

a reservoir the interior of which is maintained constantly at atmospheric pressure;

valve and conduit means for selectively providing fluid communication between said cooling circuit and said reservoir; and a control circuit for controlling the operation of said valve and conduit means.

3. A cooling system as claimed in claim 2, further comprising a device disposed with said radiator for varying the rate of heat exchange between a cooling medium surrounding the radiator and said radiator.

4. A cooling system as claimed in claim 3, wherein said coolant return means includes:

a first level sensor disposed in said coolant jacket at a first predetermined level, said first predetermined level being selected to be above the engine structure which is subject to high heat flux;

a coolant return conduit leading from said radiator to said coolant jacket; and a coolant return pump disposed in said coolant return conduit, said coolant return pump being responsive to said first level sensor in a manner to pump liquid coolant from said radiator to said coolant jacket in responsive to said first level sensor indicating that the level of liquid coolant has fallen thereto.

5. A cooling system as claimed in claim 4, wherein said valve and conduit means includes a second level sensor, said second level sensor being disposed in a small collection vessel disposed at the bottom of said radiator.

6. A cooling system as claimed in claim 5, wherein said valve and conduit means further comprises:

an overflow conduit leading from an upper section of said coolant jacket to said radiator;

a first valve disposed in said overflow conduit, said first valve having a first position wherein communication between said coolant jacket and said reservoir is cut-off and a second position wherein communication between said coolant jacket and said reservoir is permitted;

a second valve disposed in said coolant return conduit between said radiator and said coolant return pump;

an induction conduit leading from said reservoir to said second valve, said second valve having a first position wherein communication between said radiator and said pump is established and a second position wherein communication between said radiator and said pump is interrupted and communication between said reservoir and said pump established;

a fill/discharge conduit leading from said reservoir to said cooling circuit; and a third valve disposed in said fill/discharge conduit, said third valve having a first position wherein communication between said reservoir and said radiator is permitted and a second position wherein communication between said radiator and said cooling circuit is interrupted.

7. A cooling system as claimed in claim 6, further including a second parameter sensor for sensing a parameter which varies with load on said engine.

8. A cooling system as claimed in claim 7, wherein said control circuit further includes means for:

sensing the load on said engine;

determining a target temperature to which the coolant in said coolant jacket should be maintained for the given engine load;

operating said device in manner to increase the amount of heat exchanged between the cooling medium surrounding the radiator and said radiator.

9. A cooling system as claimed in claim 8, wherein said control circuit further includes means for:

sensing the temperature of the coolant being below a second predetermined level;

conditioning said valve and conduit means and said coolant return pump in a manner to induct coolant from said resrevoir via said induction conduit and pump same into said cooling circuit and permit the excess coolant to overflow back to said reservoir via said overflow conduit and further conditioning said coolant circulation pump to circulate coolant through said core in said first flow direction in a manner which flushes non-condensible matter out of said cooling circuit.

10. A cooling system as claimed in claim 9, wherein said control circuit further includes means for:

conditioning said valve and conduit means to introduce coolant from said reservoir to said cooling circuit in the event that the temperature of the coolant in said coolant jacket falling below a third predetermined temperature.

11. A cooling system as claimed in claim 1, wherein said heat exchanger comprises:

an upper tank;

a first lower tank;

a second lower tank;

a first plurality of pipes interconnecting said upper tank and said first lower tank;

a second plurality of pipes interconnecting said upper tank and said second lower tank, said first lower tank being connected with said lubrication system in a manner to receive lubricant therefrom, said second lower tank being connected with said lubrication system in a manner to return lubricant introduced through said first lower tank thereto.

12. A cooling system as claimed in claim 11, wherein said housing is arranged so as to be below the level at which the coolant in said coolant jacket is maintained.

13. A cooling system as claimed in claim 12, wherein said housing is arranged so that the top of same is above the level at which the coolant in said coolant jacket is maintained and so that said heat exchanger is below said level.

14. A cooling system as claimed in claim 1, wherein said housing is separate from the internal combustion engine and detachably secured to the same.

15. A cooling system as claimed in claim 1, wherein said housing is formed with a port though which liquid coolant can be introduced thereinto from said coolant jacket, and a second port via which coolant vapor can be transferred to one of said coolant jacket and said vapor transfer conduit.

* * * * *